US006718148B2

(12) United States Patent
Kobayashi et al.

(10) Patent No.: US 6,718,148 B2
(45) Date of Patent: Apr. 6, 2004

(54) PROCESS CARTRIDGE, ELECTROPHOTOGRAPHIC APPARATUS AND IMAGE-FORMING METHOD

(75) Inventors: Hiroyuki Kobayashi, Shizuoka (JP); Akihiko Nakazawa, Shizuoka (JP); Atsushi Tanaka, Shizuoka (JP); Tsunenori Ashibe, Kanagawa (JP); Takashi Kusaba, Shizuoka (JP); Hidehiko Matsuda, Shizuoka (JP); Yuji Sakurai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/152,561

(22) Filed: May 23, 2002

(65) Prior Publication Data

US 2003/0063920 A1 Apr. 3, 2003

(30) Foreign Application Priority Data

May 28, 2001 (JP) ..... 2001-158519

(51) Int. Cl.[7] ..... G03G 21/18
(52) U.S. Cl. ..... 399/113
(58) Field of Search ..... 399/107, 110, 399/111, 113, 125, 302, 308

(56) References Cited

U.S. PATENT DOCUMENTS

| | | | | |
|---|---|---|---|---|
| 4,873,548 A | | 10/1989 | Kobayashi et al. | 355/200 |
| 5,331,373 A | | 7/1994 | Nomura et al. | 355/200 |
| 5,446,525 A | | 8/1995 | Kobayashi | 355/210 |
| 5,452,056 A | | 9/1995 | Nomura et al. | 355/211 |
| 5,585,889 A | | 12/1996 | Shishido et al. | 355/200 |
| 5,585,902 A | | 12/1996 | Nishiuwatoko et al. | 355/260 |
| 5,587,769 A | | 12/1996 | Sawada et al. | 355/200 |
| 5,713,067 A | | 1/1998 | Mizoe et al. | 399/176 |
| 5,752,131 A | | 5/1998 | Fujiwara et al. | 399/106 |
| 5,802,427 A | | 9/1998 | Sawada et al. | 399/122 |
| 5,870,654 A | | 2/1999 | Sato et al. | 399/109 |
| 5,966,566 A | | 10/1999 | Odagawa et al. | 399/109 |
| 6,192,211 B1 | * | 2/2001 | Kimura | 399/227 |
| 6,493,528 B2 | * | 12/2002 | Sameshima et al. | 399/111 |

FOREIGN PATENT DOCUMENTS

| | | |
|---|---|---|
| JP | 8-137181 | 5/1996 |
| JP | 10-177329 | 6/1998 |
| JP | 11-30944 | 2/1999 |

* cited by examiner

*Primary Examiner*—Hoan Tran
(74) *Attorney, Agent, or Firm*—Fitzpatrick, Cella, Harper & Scinto

(57) ABSTRACT

A process cartridge integrally supports an electrophotographic photosensitive member, an intermediate transfer belt, primary transferer for transferring a toner image primarily from the member to the belt, a charge provider for providing the toner on the belt with electric charges having a polarity reverse to the polarity the toner has at the time of the primary transfer and returning the toner on the belt to the member at a contact zone to clean the belt, and an electrophotographic-photosensitive-member cleaner. The cartridge is dividable into an electrophotographic photosensitive member unit and an intermediate transfer belt unit and has a joining unit which joins the two units. The peripheral length and average thickness of the belt and the diameter of at least one of rollers over and around which the belt is placed satisfy specific conditions.

18 Claims, 7 Drawing Sheets

PROCESS CARTRIDGE, ELECTROPHOTOGRAPHIC APPARATUS AND IMAGE-FORMING METHOD

BACKGROUND OF THE INVENTION

1. Field of the Invention

This invention relates to a process cartridge which is detachably mountable on the main body of an electrophotographic apparatus such as a color copying machine or a color printer, and also to an electrophotographic apparatus having the process cartridge, and an image-forming method making use of the electrophotographic apparatus.

2. Related Background Art

Color electrophotographic apparatus making use of an intermediate transfer member (intermediate transfer belt) conventionally have a cartridge construction in which, as disclosed in Japanese Patent Application Laid-open No. 8-137181, an electrophotographic photosensitive member unit and an intermediate transfer belt unit are independent of each other. The electrophotographic apparatus disclosed therein is so constructed that its movable-side frame can be turned around toward the front of the apparatus to open it and the electrophotographic photosensitive member unit and the intermediate transfer belt unit can each be inserted from the upper part.

On the projection upper side of the intermediate transfer belt, an electrophotographic photosensitive member unit in which a drum-shaped electrophotographic photosensitive member (photosensitive drum) and a waste-toner holder box provided on the backside are integrally supported is provided so that waste toner on the electrophotographic photosensitive member is scraped off with a cleaning blade as a cleaning means and collected in the waste-toner holder box.

Waste toner on the intermediate transfer belt is also scraped off with another cleaning blade, then transported to the lower part of a first transport pipe by means of a transport coil, and further transported by means of a screw in the first transport pipe, to the upper part at which the waste-toner holder box is provided. Thereafter, it is transported through the interior of a second transport pipe by means of a transport coil, and at length collected in the waste-toner holder box.

At a joint where the second transport pipe is joined to the waste-toner holder box, since the above electrophotographic apparatus is so constructed that the electrophotographic photosensitive member unit and the intermediate transfer belt unit are independent units and are each attached or detached, a shutter is opened or closed so that the waste toner does not spill out when they are attached or detached.

However, in the technique disclosed in the above publication, the intermediate transfer belt and the electrophotographic photosensitive member are set respectively in the different units, namely, there are two process cartridges, and hence it is troublesome for users to replace the process cartridges.

In addition, the waste toner may escape from the waste-toner connecting part between the two process cartridges, and when the process cartridges are attached or detached, the procedure is designated, and hence usability deteriorates.

Moreover, since the apparatus has two types of process cartridges, twofold process cartridge insert guides and twofold cartridge fastener members are required. Hence, the whole electrophotographic apparatus becomes larger and the number of component parts increases, resulting in a high cost.

A large opening must be provided in order to attach or detach the two types of process cartridges, and the electrophotographic apparatus is so constructed that the whole front part thereof can be turned around to open. Hence, even though a damper mechanism is provided, this is a heavy-labor motion for users, and a large space and a high frame rigidity are required for such an opening-motion mechanism, resulting in a much higher cost. These are disadvantages of this type of apparatus.

Meanwhile, in Japanese Patent Applications Laid-open No. 11-30944 and No. 10-177329, a process cartridge is proposed in which a belt-shaped electrophotographic photosensitive member (photosensitive belt), an intermediate transfer belt and a waste-toner holder box are integrally constructed.

In the construction disclosed in these publications, the electrophotographic photosensitive member and the waste-toner holder box are disposed on the projection lower side of the intermediate transfer belt.

The apparatus is so constructed that, like the related art disclosed in Japanese Patent Application Laid-open No. 8-137181, a large movable-side frame can be turned around toward the front of the electrophotographic apparatus to open and the process cartridge in which the intermediate transfer belt, the electrophotographic photosensitive member and the waste-toner holder box are integrally held is inserted from the upper part.

The waste toner remaining on the intermediate transfer belt and the electrophotographic photosensitive member is scraped off with cleaning blades as cleaning means provided respectively for the two, and then collected in the waste-toner holder box.

The waste toner coming from the intermediate transfer belt drops downward from the upper part. This construction is not so complicated as the related art disclosed in Japanese Patent Application Laid-open No. 8-137181. However, like the related art disclosed in Japanese Patent Application Laid-open No. 8-137181, the waste toner is transported from the intermediate transfer belt and the waste toner is transported from the electrophotographic photosensitive member. Thus, the method for collecting the waste toner is troublesome and cumbersome, and besides, there still remains the risk that the toner may escape during transport.

SUMMARY OF THE INVENTION

An object of the present invention is to provide a novel process cartridge, an electrophotographic apparatus having such a process cartridge and an image-forming method making use of the electrophotographic apparatus, which have solved the problems the related art has had.

Stated specifically, an object of the present invention is to provide a novel process cartridge which can eliminate the user's difficulty in replacing the process cartridge, can also prevent usability from being damaged by, e.g., the escape of waste toner from the waste-toner connecting part between the two process cartridges, can still also be kept from an increase in the cost and can further realize enhanced travel performance, durability, image quality and transfer performance of the intermediate transfer belt, and also provide an electrophotographic apparatus having such a process cartridge and an image-forming method making use of the electrophotographic apparatus.

More specifically, the present invention is a process cartridge which is detachably mountable on the main body of an electrophotographic apparatus; the process cartridge comprising the following integrally supported therein:

an electrophotographic photosensitive member for holding thereon a toner image;

an intermediate transfer belt having a contact zone coming into contact with the electrophotographic photosensitive member;

a primary-transfer means for primarily transferring the toner image from the electrophotographic photosensitive member to the intermediate transfer belt at the contact zone;

a charge-providing means for providing the toner on the intermediate transfer belt with electric charges having a polarity reverse to a polarity the toner has at the time of the primary transfer and returning the toner on the intermediate transfer belt to the electrophotographic photosensitive member at the contact zone to clean the intermediate transfer belt; and an electrophotographic-photosensitive-member cleaning means for cleaning the electrophotographic photosensitive member;

the process cartridge being dividable into an electrophotographic photosensitive member unit having the electrophotographic photosensitive member and an intermediate transfer belt unit having the intermediate transfer belt, and having a joining means which joins the electrophotographic photosensitive member unit and the intermediate transfer belt unit together; and the peripheral length L (mm) of the intermediate transfer belt, the average thickness t (mm) of the intermediate transfer belt and the diameter R (mm) of at least one of rollers over and around which the intermediate transfer belt is placed satisfying all the following expressions (1) to (4):

(1) $2\times10^2\pi \leqq L/t \leqq 4\times10^4\pi$;

(2) $2\times10^{-4} \leqq t/R \leqq 1.5\times10^{-2}$;

(3) $0.005<t<0.6$; and (4) $5<R<90$.

The present invention is also an electrophotographic apparatus comprising:

an electrophotographic photosensitive member for holding thereon a toner image;

a charging means for electrostatically charging the electrophotographic photosensitive member;

an exposure means for forming an electrostatic latent image on the electrophotographic photosensitive member thus charged by the charging means;

a developing means for developing with toner the electrostatic latent image formed on the electrophotographic photosensitive member by the exposure means, to form a toner image on the electrophotographic photosensitive member;

an intermediate transfer belt having a contact zone coming into contact with the electrophotographic photosensitive member, through which the toner image is primarily transferred from the electrophotographic photosensitive member and thereafter the toner image having primarily been transferred is secondarily transferred to a transfer medium;

a primary-transfer means for primarily transferring the toner image from the electrophotographic photosensitive member to the intermediate transfer belt at the contact zone;

a charge-providing means for providing the toner on the intermediate transfer belt with electric charges having a polarity reverse to a polarity the toner has at the time of the primary transfer and returning the toner on the intermediate transfer belt to the electrophotographic photosensitive member at the contact zone to clean the intermediate transfer belt; and an electrophotographic-photosensitive-member cleaning means for cleaning the electrophotographic photosensitive member;

the electrophotographic apparatus having a process cartridge in which the electrophotographic photosensitive member, the intermediate transfer belt, the primary-transfer means, the charge-providing means and the electrophotographic-photosensitive-member cleaning means at least are integrally supported and detachably mountable on the main body of the electrophotographic apparatus;

the process cartridge being dividable into an electrophotographic photosensitive member unit having the electrophotographic photosensitive member and an intermediate transfer belt unit having the intermediate transfer belt, and having a joining means which joins the electrophotographic photosensitive member unit and the intermediate transfer belt unit together; and the peripheral length L (mm) of the intermediate transfer belt, the average thickness t (mm) of the intermediate transfer belt and the diameter R (mm) of at least one of rollers over and around which the intermediate transfer belt is placed satisfying all the following expressions (1) to (4):

(1) $2\times10^2\pi \leqq L/t \leqq 4\times10^4\pi$;

(2) $2\times10^{-4} \leqq t/R \leqq 1.5\times10^{-2}$;

(3) $0.005<t<0.6$; and (4) $5<R<90$.

The present invention also relates to an image-forming method comprising:

a charging step of electrostatically charging an electrophotographic photosensitive member;

an exposure step of forming an electrostatic latent image on the electrophotographic photosensitive member thus charged in the charging step;

a developing step of developing with toner the electrostatic latent image formed on the electrophotographic photosensitive member in the exposure step, to form a toner image on the electrophotographic photosensitive member;

a primary-transfer step of primarily transferring the toner image formed in the developing step from the electrophotographic photosensitive member to an intermediate transfer belt by a primary-transfer means, the intermediate transfer belt having a contact zone coming into contact with the electrophotographic photosensitive member;

a secondary-transfer step for secondarily transferring to a transfer medium the toner image having primarily been transferred in the primary-transfer step;

a charge-providing step of providing the toner on the intermediate transfer belt with electric charges by a charge-providing means, the electric charges having a polarity reverse to a polarity the toner has at the time of the primary transfer;

an intermediate-transfer-belt cleaning step of returning the toner on the intermediate transfer belt to the electrophotographic photosensitive member at the contact zone to clean the intermediate transfer belt; and an electrophotographic-photosensitive-member cleaning step of cleaning the electrophotographic photosensitive member with an electrophotographic-photosensitive-member cleaning means;

the image-forming method making use of an electrophotographic apparatus having a process cartridge in which the electrophotographic photosensitive member, the intermediate transfer belt, the primary-transfer means, the charge-providing means and the electrophotographic-photosensitive-member cleaning means at least are integrally supported and detachably mountable on the main body of the electrophotographic apparatus;

the process cartridge being dividable into an electrophotographic photosensitive member unit having the electrophotographic photosensitive member and an intermediate transfer belt unit having the intermediate transfer belt, and having a joining means which joins the electrophotographic photosensitive member unit and the intermediate transfer belt unit together; and the peripheral length L (mm) of the intermediate transfer belt, the average thickness t (mm) of the intermediate transfer belt and the diameter R (mm) of at least one of rollers over and around which the intermediate transfer belt is placed satisfying all the following expressions (1) to (4):

(1) $2\times10^2\pi L/t \leqq 4\times10^4\pi$;

(2) $2\times10^{-4} \leqq t/R \leqq 1.5\times10^{-2}$;

(3) $0.005<t<0.6$; and (4) $5<R<90$.

The above process cartridge, electrophotographic photosensitive member and image-forming method of the present invention, having the construction described above have the following advantages 1) to 5).

1) After taking the process cartridge for an electrophotographic apparatus out of the main body of the electrophotographic apparatus, users may divide the process cartridge thus taken out, into the electrophotographic photosensitive member unit and the intermediate transfer belt unit, and may replace only any unit having reached the end of its service life. Thus, some cost burden on users can be reduced.

2) On the side of manufacturers, too, there is an advantage that the matter can be dealt with by replacing only any defective unit.

3) A process cartridge can also be provided in which an intermediate transfer belt and an electrophotographic photosensitive member which are small-sized and low-cost are integrally supported, and hence the main body of the electrophotographic apparatus can also be small-sized. In addition, the opening for attaching or detaching the process cartridge can be set to be small and simple, so that the whole electrophotographic apparatus can be made low-cost.

As stated above, the process cartridge of the present invention employs a method in which the toner remaining on the intermediate transfer belt is returned to the electrophotographic photosensitive member at the contact zone between the intermediate transfer belt and the electrophotographic photosensitive member to clean the intermediate transfer belt (a cleaning-at-primary-transfer method or a bias cleaning method). As a means for charging the toner to a reverse polarity, which is necessary for such a cleaning method, a blade or a corona charging assembly may be used. Any means, however, may be used as long as electric charges can be applied to the toner remaining on the intermediate transfer belt without being transferred (transfer residual toner).

The transfer residual toner returned from the surface of the intermediate transfer belt to the electrophotographic photosensitive member is removed by an electrophotographic-photosensitive-member cleaning means such as a cleaning blade.

4) This bias cleaning method is greatly effective to make the process cartridge compact and low-cost, compared with a method in which cleaning blades or the like are provided for both the intermediate transfer belt and the electrophotographic photosensitive member and a feed mechanism for waste toner and a container therefor are installed.

Moreover, the intermediate transfer belt to be mounted on this process cartridge and be placed over and around rollers, and the rollers which transport and drive the intermediate transfer belt must not only show the above advantages but also contribute to good electrophotographic performances.

For example, large-diameter rollers are favorable for maintaining registration, but hinder miniaturization of the process cartridge.

The relationship between the intermediate transfer belt and the rollers may have an influence on the peripheral speed of the belt, and cause color misregistration when four-color toners are superimposed.

In addition, it is preferred that in general, the larger the peripheral length of the intermediate transfer belt, the thicker the belt. However, the thickness is limited in order to make the process cartridge compact. In particular, the thickness of the intermediate transfer belt may have a great influence on the value of a transfer electric field formed when the toner is transferred, and it can not easily be made large when the primary- and secondary-transfer performance of the intermediate transfer belt is taken into account.

5) Namely, where the peripheral length and average thickness of the intermediate transfer belt to be mounted on the process cartridge and the diameter of at least one of rollers over and around which the intermediate transfer belt is placed satisfy the above specific relationship, not only the above advantages, but also good electrophotographic performances can be exhibited.

DETAILED DESCRIPTION OF THE PREFERRED EMBODIMENTS

Figure 1:
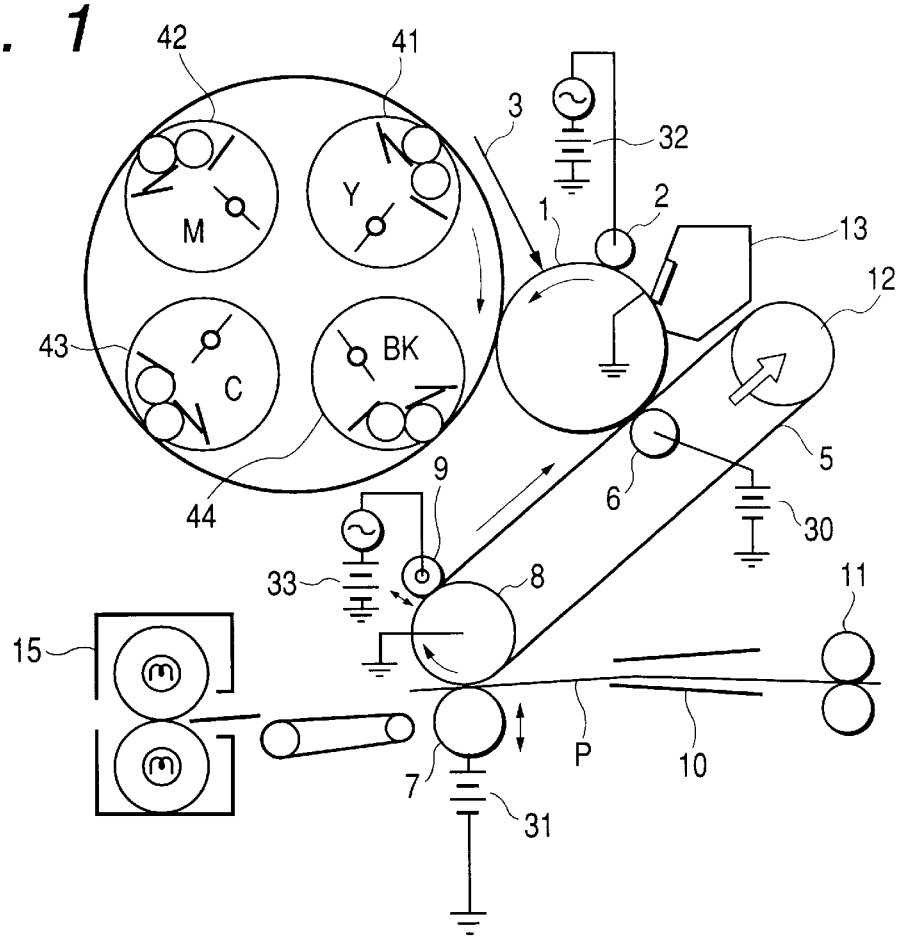
FIG. 1 is a schematic sectional view showing an example of an electrophotographic apparatus making use of the intermediate transfer belt/electrophotographic photosensitive member integral cartridge of the present invention.

The process cartridge of the present invention is a process cartridge in which an intermediate transfer belt and an electrophotographic photosensitive member are integrally supported (herein also "intermediate transfer belt/electrophotographic photosensitive member integral cartridge"). Hence, the synchronization of the electrophotographic photosensitive member with the intermediate transfer belt must precisely be controlled.

In general, it is considered that stabler synchronization can be attained where a force is received from the same drive system to rotate the intermediate transfer belt and the electrophotographic photosensitive member.

For that end, however, the intermediate transfer belt is required to have a dimensional precision at a level higher than that in the case of an independent drive. This is because, if it is independently driven, its drive may be controlled in accordance with the precision of the size or peripheral length of the intermediate transfer belt, but, if it is driven with the same drive system, drive conditions can not absolutely be determined from their relationship with drive controllability determined on the basis of the dimensional precision of the electrophotographic photosensitive member.

In the relationship between the diameters of rollers over and around which an intermediate transfer belt is placed (with which it is driven and transported) and the thickness of the intermediate transfer belt, it is preferred that the roller has a larger diameter and the intermediate transfer belt has a smaller thickness, because it is harder for unevenness of the travel speed to occur.

The diameter of the roller has a great influence on the volume of the process cartridge, and the thickness of the intermediate transfer belt has an influence on the durability of the intermediate transfer belt when repeatedly rotated and on the travel performance such that the belt does not come on one side or meander.

Hence, it is necessary that, as specified previously, the peripheral length L (mm) of the intermediate transfer belt, the average thickness t (mm) of the intermediate transfer belt and the diameter R (mm) of at least one of rollers over and around which the intermediate transfer belt is placed satisfy all the following expressions (1) to (4):

(1) $2\times10^2\pi \leqq L/t \leqq 4\times10^4\pi$;

(2) $2\times10^{-4} \leqq t/R \leqq 1.5\times10^{-2}$;

(3) $0.005<t<0.6$; and (4) $5<R<90$.

If the intermediate transfer belt has an average thickness of 0.005 or less, the intermediate transfer belt may have too insufficient a strength to maintain its durability for a long time. If it has an average thickness of 0.6 mm or more, the belt may have too large a rigidity to achieve stable travel performance.

If the roller has a diameter of 5 mm or less, though such a roller is advantageous for making the apparatus compact, trouble may arise in disposing a roller-shaped charge-providing means (intermediate-transfer-belt cleaning roller), primary- and secondary-transfer means and a belt-tension control member which are necessary for the intermediate transfer belt to exhibit its function. If, on the other hand, it has a diameter of 90 mm or more, the process cartridge may become too large to make the apparatus compact and light-weight as intended in the present invention, and may adversely affect its handling, carriage and production cost.

It is more preferable that the diameters of all rollers over and around which the intermediate transfer belt is placed and the peripheral length and average thickness of the intermediate transfer belt satisfy all the above expressions (1) to (4).

The intermediate transfer belt may preferably have a surface roughness Ra of 1 $\mu$m or less.

If it has a surface roughness Ra of more than 1 $\mu$m, the transfer performance may be affected to cause coarse half-tone images or deterioration in fine-line reproducibility. Since the bias cleaning method is employed as the method of cleaning the intermediate transfer belt, if it has a surface roughness Ra of more than 1 $\mu$m, the electric charges imparted to the secondary-transfer residual toner may be non-uniform, so that intermediate transfer belt faulty cleaning may occur in which the toner is not well returned to the electrophotographic photosensitive member to cause such a problem that previously printed images remain on subsequently printed images at the time of continuous printing.

These problems concerning images may remarkably occur especially in electrophotographic apparatus employing a digital exposure means with a resolution of 600 dpi or more.

In order to make the intermediate transfer belt/electrophotographic photosensitive member integral cartridge have a smaller size and lower price, it is also important to select the shape of the electrophotographic photosensitive member. Accordingly, the electrophotographic photosensitive member may preferably be a small-diameter, drum-shaped electrophotographic photosensitive member (photosensitive drum) formed of a rigid body having a diameter of 60 mm or less, which has a simple drive mechanism and is easy to make compact.

For the same purpose as the above, the intermediate transfer belt may be one which is placed over and around two rollers consisting of, e.g., a drive roller and a tension roller. This is more preferable because the number of component parts can be cut down and the cartridge can be made more compact.

The tension roller, which applies tension to the intermediate transfer belt, must slide by at least 1 mm with respect to the direction of elongation of the intermediate transfer belt, in order to deal with any elongation of the intermediate transfer belt. In order for the intermediate transfer belt to be surely driven without slipping, the intermediate transfer belt may preferably be fitted over and around the two rollers at a force of 5 N or more.

As to the intermediate transfer belt, its resistivity must also be regulated. The intermediate transfer belt may have a volume resistivity of from $1\times10^2$ Ω·cm to $8\times10^{13}$ Ω·cm, within the range of which good images are obtainable. If it has a volume resistivity lower than $1\times10^2$ Ω·cm, it may have too low an electrical resistance to provide a sufficient transfer electric field, tending to cause blank areas in images or coarse images. If, on the other hand, it has a volume resistivity higher than $8\times10^{13}$ Ω·cm, the transfer voltage must also be made higher, requiring a power source to have a large size or resulting in a higher cost.

The materials constituting the intermediate transfer belt used in the process cartridge and the electrophotographic apparatus of the present invention, are roughly grouped into a binder and an electrical-resistance control agent.

As the binder, rubbers, elastomers, elastic materials, foamed materials and resins may be used. Thermoplastic resins or thermosetting resins may preferably be used. In particular, thermoplastic resins are preferred.

The thermoplatic resins may include, e.g., styrene resins (homopolymers or copolymers which contain styrene or a styrene derivative) such as polystyrene, polychlorostyrene, poly-α-methylstyrene, a styrene-butadiene copolymer, a styrene-vinyl chloride copolymer, a styrene-vinyl acetate copolymer, a styrene-maleic acid copolymer, styrene-acrylate copolymers (such as a styrene-methyl acrylate copolymer, a styrene-ethyl acrylate copolymer, a styrene-butyl acrylate copolymer, a styrene-octyl acrylate copolymer and a styrene-phenyl acrylate copolymer), styrene-methacrylate copolymers (such as a styrene-methyl methacrylate copolymer, a styrene-ethyl methacrylate copolymer and a styrene-phenyl methacrylate copolymer), a styrene-methyl α-chloroacrylate copolymer and styrene-acrylonitrile-acrylate copolymers; as well as methyl methacrylate resin, butyl methacrylate resin, ethyl acrylate resin, butyl acrylate resin, modified acrylic resins (such as silicone modified acrylic resin, vinyl chloride modified acrylic resin and acryl-urethane resin), vinyl chloride resin, a styrene-vinyl acetate copolymer, a vinyl chloride-vinyl acetate copolymer, modified maleic resin, phenolic resins, epoxy resins, polyester resins, polyester polyurethane resins, polyethylene, polypropylene, polybutadiene, polyvinylidene chloride, ionomer resins, polyurethane resins, silicone resins, fluorine resins, ketone resins, an ethylene-ethyl acrylate copolymer, xylene resins, polyvinyl butyral resin, polyimide resins, polyamide resins, modified polyphenylene oxide resins, polyarylate resins, polyamide-imide resins, polyether imide resins, polyether ether ketone resin, polysulfone resin, polyether sulfone resin, polycarbonate resin, polyphenylene sulfide resin, polyethylene terephthalate resin, polybutylene terephthalate resin, modified polyphenylene ether resins, and polybenzimidazole resin.

Among these, a resin may be used alone or two or more resins may be used in combination. In the present invention, examples are by no means limited to the above materials.

As the electrical-resistance control agent for regulating the electrical-resistance value of the intermediate transfer belt, an electron-conductive resistance control agent or an ion-conductive resistance control agent may be used.

The electron-conductive resistance control agent may include, e.g., carbon black, graphite, aluminum-doped zinc oxide, tin-oxide-coated titanium oxide, tin oxide, tin-oxide-coated barium sulfate, potassium titanate, aluminum metal powder and nickel metal powder.

The ion-conductive resistance control agent may include, e.g., tetraalkylammonium salts, trialkylbenzylammonium salts, alkyl sulfonates, alkylbenzene sulfonates, alkyl sulfates, glycerol fatty esters, sorbitan fatty esters, polyoxyethylene alkyleneamines, polyoxyethylene fatty alcohol esters, alkylbetaines, and lithium perchlorate.

In particular, the use of polyether ester amide resin, which is an antistatic resin and a copolymer of a polyether component with a polyamide component, is preferred because this resin has good compatibility with the resin for producing the intermediate transfer belt by extrusion and can provide a uniform electrical resistance.

In the present invention, examples are by no means limited to the above materials.

There are no particular limitations on the means by which the surface roughness of the intermediate transfer belt is regulated. For example, a method is available in which regulation is effected in such a way that, when extrusion is carried out, resin materials are selected for melt properties and temperature conditions and cooling conditions at the time of extrusion are adjusted so that more smooth surface can be attained when an extruded product, melt-extruded into a film, is solidified from a molten state.

Other available methods include a method in which a product extruded into a belt is heated, applying a smooth form (for shaping) so as to have the same surface state as the form, and a method in which the surface of a belt is polished.

The process for producing the intermediate transfer belt may preferably be a production process which can produce a seamless belt and has a high production efficiency to enable cost saving. As a means therefor, a method is available in which an extrusion material is continuously melt extruded from a circular die and thereafter the product thus extruded is cut in a necessary length to produce a belt. For example, blown-film extrusion (inflation) is preferred.

An example of the process for producing the intermediate transfer is described below. It should be noted that the present invention is by no means limited by this example.

Figure 3:
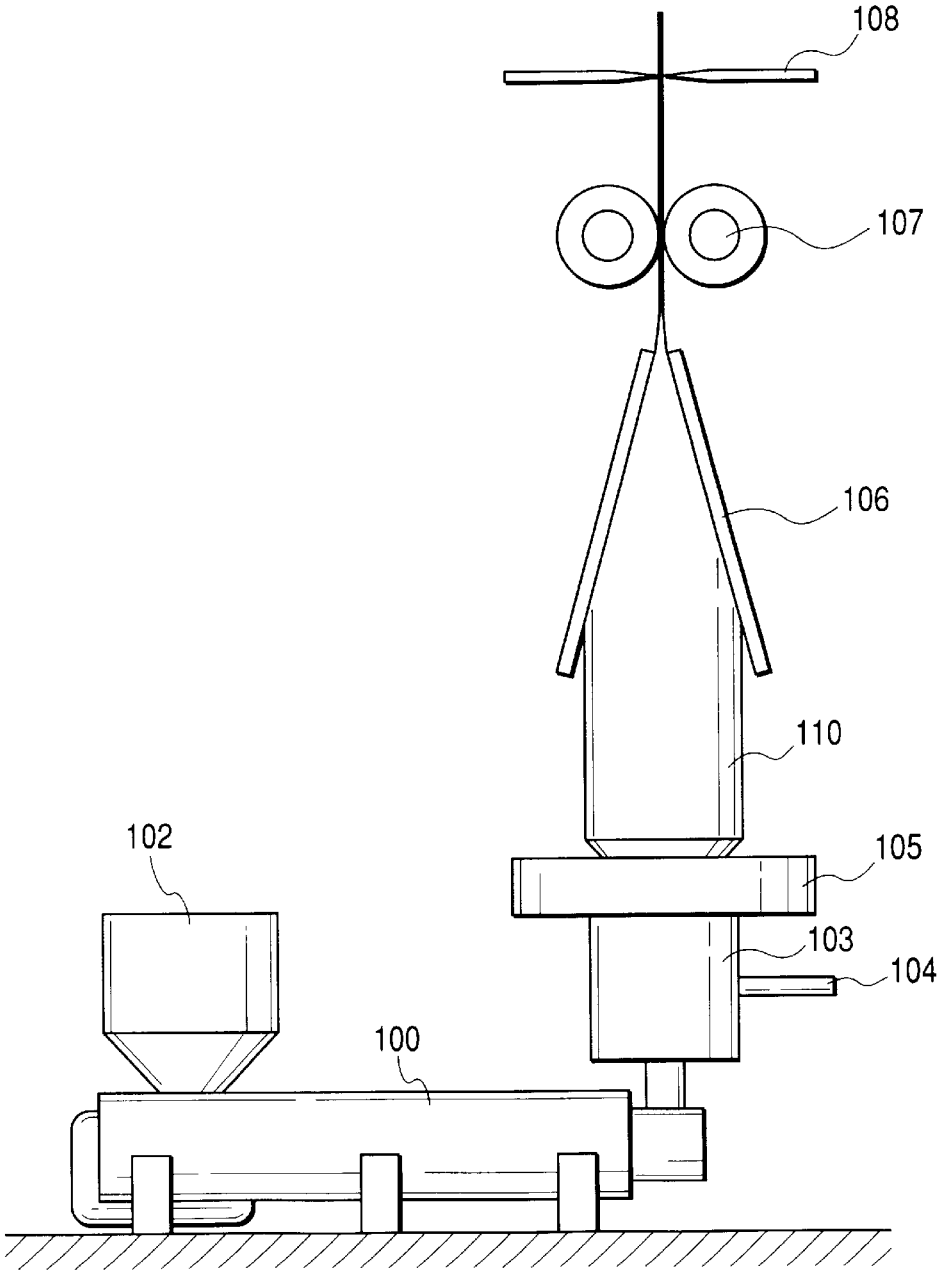
FIG. 3 is a view showing an example of an apparatus for producing the intermediate transfer belt (single layer).

FIG. 3 shows an example of an apparatus for producing the intermediate transfer belt used in the process cartridge of the present invention. This production apparatus consists chiefly of an extruder 100, an extruder die 103, and a gas blowing unit having a gas inlet passage 104.

First, an extrusion resin, a conducting agent and additives are premixed under the desired formulation and thereafter kneaded and dispersed to prepare an extrusion material, which is then put into a hopper 102 installed in the extruder 100.

The extruder 100 has a preset temperature, extruder screw construction and so forth which have been so selected that the extrusion material may have a melt viscosity necessary for enabling the extrusion into a belt in the subsequent step and the materials can be dispersed uniformly with one another. The extrusion material is melt-kneaded in the extruder 100 into a melt, which then enters a circular die 103.

The circular die 103 is provided with a gas inlet passage 104. Through the gas inlet passage 104, a gas is blown into the circular die 103, whereupon the melt having passed through the circular die 103 in a tubular form inflates while scaling up in the diametrical direction.

The gas to be blown here may be air, and besides, may be selected from nitrogen, carbon dioxide and argon.

The extruded product having thus inflated is drawn upward while being cooled by an outside-cooling ring 105, and formed into a tubular film 110. Usually, in such a blown-film extrusion apparatus, a method is employed in which the tubular film 110 is pressed forcibly from the right and the left by means of stabilizing plates 106 to fold it into a sheet, and then drawn off at a constant speed while being so sandwiched with pinch rollers 107 that the air in the interior does not escape. Then, the film 110 thus drawn off is cut with a cutter 108 to obtain a tubular film with the desired size.

Next, this tubular film is worked using a form (for shaping) in order to regulate its surface smoothness and size and to remove any folds made in the film at the time of draw-off.

Stated specifically, a method is usable which makes use of a pair of cylindrical forms which are made of materials which are different from each other in their coefficients of thermal expansion and diameter.

In this method, a small-diameter cylindrical form (inner form) is so made as to have a coefficient of thermal expansion larger than the coefficient of thermal expansion of a large-diameter cylindrical form (outer form). A tubular film obtained by extrusion is placed over this inner form. Thereafter, the inner form with film is inserted into the outer form so that the tubular film is held between the inner form and the outer form. A gap between the inner form and the outer form may be determined by calculation on the bases of heating temperature, the difference in the coefficients of thermal expansion between the inner form and the outer form, and the pressure required.

The form set having in this order the inner form, the tubular film and the outer form is heated to the vicinity of the softening point temperature of the resin. As a result of the heating, the inner form, having a larger coefficient of thermal expansion, expands more than the outer form and a uniform pressure is applied to the whole tubular film (resin film). Here, the surface of the resin film having reached the vicinity of its softening point is pressed against the inner surface of the outer form having been worked smoothly, so that the smoothness of the surface of the resin film is improved. Thereafter, these are cooled and the film is removed from the forms, thus attaining smooth surface characteristics.

Thereafter, this tubular film is optionally fitted with a reinforcing member, a guide member and a position detection member, and is precisely cut to produce the intermediate transfer belt.

Figure 4:
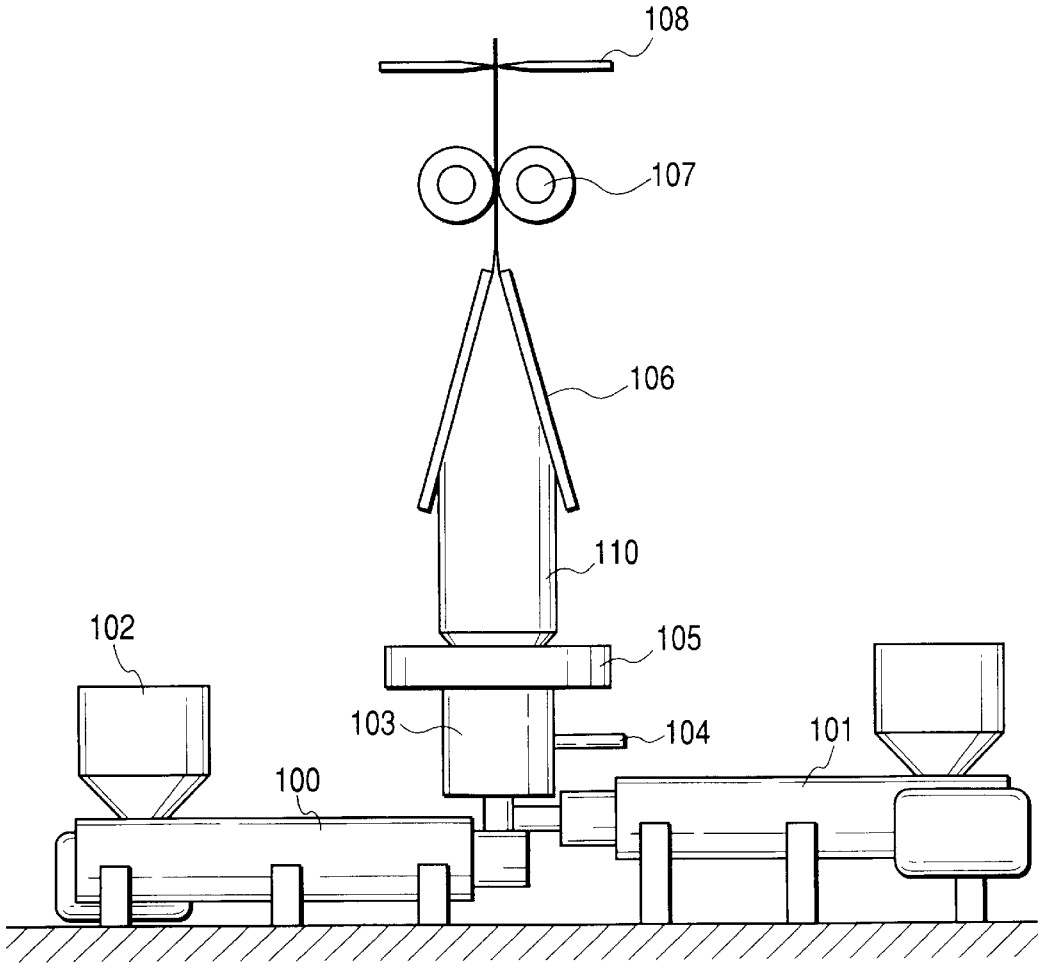
FIG. 4 is a view showing an example of an apparatus for producing the intermediate transfer belt (double layer).

The foregoing description relates to a single-layer belt. In the case of a belt of double-layer construction, an extruder 101 is additionally provided as shown in FIG. 4. Simultaneously with the kneaded melt held in the extruder 100, a kneaded melt in the extruder 101 is sent to a double-layer circular die 103, and the two layers are scale-up inflated simultaneously, thus obtaining a double-layer belt.

In the case of triple- or more layer construction, the extruder may of course be provided in the number corresponding to the number of layers.

Thus, the above intermediate transfer belt production process makes it possible to extrude not only intermediate transfer belts of single-layer construction but also those of multi-layer construction in a good dimensional precision through a series of steps and in a short time. That the extrusion can be made in a short time means that mass production and low-cost production can be performed.

As to the ratio of the extruded tubular film thickness to the circular die 103, i.e., the ratio of the thickness of the extruded tubular film to the slit width of the circular die 103, the ratio of the former to the latter may preferably be not larger than ⅓, and particularly preferably not larger than ⅕.

Similarly, the proportion between the extruded tubular film outer diameter and the circular die diameter, i.e., the ratio of the outer diameter of the tubular film 110 to the circular-die slit diameter of the circular die 103 (the outer diameter of the die slit of the circular die) is expressed by percent. It may preferably be in the range of from 50% to 400%.

These values represent the state of the stretch of the material. If the thickness ratio is larger than ⅓, the film may insufficiently stretch to tend to cause troubles such as low strength, uneven resistance and uneven thickness. If the outer diameter is more than 400% or less than 50%, the film has been stretched in excess, resulting in low extrusion stability or making it difficult to ensure the necessary thickness required in the present invention.

Then, an example of an electrophotographic apparatus making use of the intermediate transfer belt/electrophotographic photosensitive member integral cartridge of the present invention is shown in FIG. 1.

The apparatus shown in FIG. 1 is a color electrophotographic apparatus such as a color copying machine or a color laser beam printer.

Reference numeral 1 denotes a rotating-drum type electrophotographic photosensitive member (photosensitive drum) serving as a first image-bearing member, which is rotatably driven at a prescribed peripheral speed (process speed) in the clockwise direction shown by an arrow.

The electrophotographic photosensitive member 1 is, in the course of its rotation, uniformly electrostatically charged to a prescribed polarity and potential by means of a primary-charging means (charging roller) 2. Reference numeral 32 denotes a power source of the primary-charging means 2. Here, a voltage formed by superimposing an AC voltage on a DC voltage is applied. Alternatively, only an AC voltage may be applied.

Then, the electrophotographic photosensitive member is exposed to light 3 by an exposure means (not shown; e.g., a color-original image color-separating/image-forming optical system, or a scanning exposure system comprising a laser scanner that outputs laser beams modulated in accordance with time-sequential electrical digital pixel signals of image information). Thus, an electrostatic latent image is formed which corresponds to a first color component image (e.g., a yellow color component image) of the intended color image.

Next, the electrostatic latent image is developed with a first-color yellow toner Y by means of a first developing means (yellow color developing assembly 41). At this stage, second to fourth developing means (magenta color developing assembly 42, cyan color developing assembly 43 and black color developing assembly 44) each stand unoperated and do not act on the electrophotographic photosensitive member 1, and hence the first-color yellow toner image is not affected by the second to fourth developing assemblies.

An intermediate transfer belt 5 is rotatably driven in the clockwise direction at the same peripheral speed as that of the electrophotographic photosensitive member 1.

While the first-color yellow toner image formed and held on the electrophotographic photosensitive member 1 passes through a contact zone formed between the electrophotographic photosensitive member 1 and the intermediate transfer belt 5, it is successively primarily transferred to the periphery of the intermediate transfer belt 5 by the aid of an electric field formed by a primary-transfer bias applied to the intermediate transfer belt 5 through a roller-shaped primary-transfer means (primary-transfer roller) 6.

The surface of the electrophotographic photosensitive member 1 from which the corresponding first-color yellow toner image has been transferred to the intermediate transfer belt 5 is cleaned by an electrophotographic-photosensitive-member cleaning means 13.

Subsequently, the second-color magenta toner image, the third-color cyan toner image and the fourth-color black toner image are sequentially similarly transferred and superimposed onto the intermediate transfer belt 5. Thus, the intended synthesized color toner image is formed.

Reference numeral 7 denotes a secondary-transfer means (secondary-transfer roller), which is provided in such a way that it is axially supported in parallel to a drive roller 8 and stands separable from the bottom surface of the intermediate transfer belt 5.

The primary-transfer bias for sequentially superimposition-transferring the first- to fourth-color toner images from the electrophotographic photosensitive member 1 to the intermediate transfer belt 5 is applied from a bias source 30 in a polarity (+) reverse to that of each toner. The voltage thus applied is, e.g., in the range of from +100 V to +2 kV.

In the step of primary transfer of the first- to third-color toner images from the electrophotographic photosensitive member 1 to the intermediate transfer belt 5, the secondary-transfer means 7 may also be set separable from the intermediate transfer belt 5.

The synthesized color toner images transferred onto the intermediate transfer belt 5 are transferred to a second image-bearing member, transfer medium P, in the following way: The secondary-transfer means 7 is brought into contact with the intermediate transfer belt 5 and simultaneously the transfer medium P is fed at a prescribed timing from a paper feed roller 11 through a transfer medium guide 10 until it reaches a contact zone formed between the intermediate transfer belt 5 and the secondary-transfer means 7, where a secondary-transfer bias is applied to the secondary-transfer means 7 from a bias power source 31. By the aid of this secondary-transfer bias, the synthesized color toner images are secondarily transferred from the intermediate transfer belt 5 onto the second image-bearing member, transfer medium P. The transfer medium P to which the toner images have been transferred is guided into a fixing means 15 and heat-fixed.

After the toner images have been transferred to the transfer medium P, a charge-providing means 9 placed in a touchable and separable state is brought into contact with the intermediate transfer belt 5, and a bias with a polarity reverse to that of the electrophotographic photosensitive member 1 is applied, whereupon electric charges with a polarity reverse to that at the time of primary transfer are imparted to toners not transferred to the transfer medium P and remaining on the intermediate transfer belt 5 (i.e., transfer residual toners). Reference numeral 33 denotes a bias power source. Here, a voltage formed by superimposing an AC voltage on a DC voltage is applied.

The transfer residual toners charged to a polarity reverse to that at the time of primary transfer are electrostatically transferred to the electrophotographic photosensitive member 1 at the zone coming into contact with the electrophotographic photosensitive member 1 and the vicinity thereof. Thus, the intermediate transfer belt 5 is cleaned. This step can be carried out simultaneously with the primary transfer, and hence does not cause any lowering of throughput.

Next, the intermediate transfer belt/electrophotographic photosensitive member integral cartridge of the present invention is described.

Figure 2:
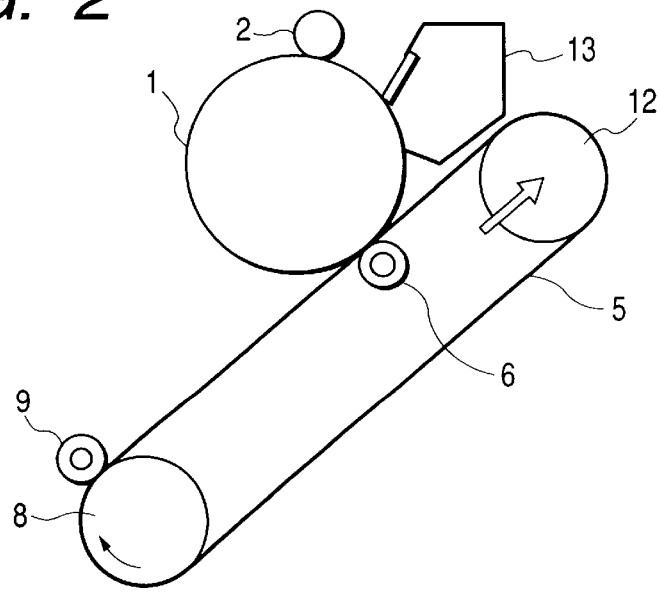
FIG. 2 is a schematic sectional view showing the construction of the process cartridge of the present invention.

The process cartridge of the present invention is, as shown in FIG. 2, so constructed that at least an electrophotographic photosensitive member 1, an intermediate transfer belt 5, a primary-transfer means 6, a charge-providing means 9 and an electrophotographic-photosensitive-member cleaning means 13 are integrally supported so that it is detachably mountable to the main body of the electrophotographic apparatus.

The cleaning of the intermediate transfer belt in the process cartridge and the electrophotographic apparatus of the present invention is performed by the method in which, as described previously, the transfer residual toner is charged to a polarity reverse to that at the time of primary transfer and thereby returned to the electrophotographic photosensitive member at the zone coming into contact with the electrophotographic photosensitive member. In the cartridge shown in FIG. 2, a roller-shaped charge-providing means 9, comprised of a medium-resistance elastic body, is provided.

As for the cleaning of the electrophotographic photosensitive member, it may preferably be performed by making use of a blade. FIG. 2 shows an embodiment in which a blade is used for the cleaning of the electrophotographic photosensitive member.

In the process cartridge shown in FIG. 2, a waste-toner container (not shown) is also integrally provided so that the transfer residual toners on both the intermediate transfer belt and the electrophotographic photosensitive member may simultaneously be discarded when the cartridge is replaced. Thus, it contributes to an improvement in maintenance performance.

The intermediate transfer belt is also placed over and around two rollers, a drive roller 8 and a tension roller 12, so that the number of component parts can be made small and the cartridge can be made compact. Here, the roller 8 is a drive roller and at the same time an opposing roller of the charge-providing means (intermediate-transfer-belt cleaning roller). The tension roller (follower roller) 12, which rotates following the intermediate transfer belt, has a sliding mechanism, and is brought into pressure contact with the inside of the belt in the direction of an arrow by the action of a compression spring to impart a tension to the intermediate transfer belt. It may be slidable in a slide width of from 1 mm to 5 mm, and may apply a spring pressure of from 5 N to 100 N in total.

The electrophotographic photosensitive member 1 and the drive roller 8 may also have a coupling (not shown) so that the rotational drive force may be transmitted from the main body.

Methods of measuring various physical properties concerning the present invention are shown below.

(I) Measurement of electrophotographic photosensitive member surface potential Vt when the intermediate transfer belt and the electrophotographic photosensitive member are rubbed with each other:

The intermediate transfer belt and the electrophotographic photosensitive member are incorporated in the intermediate transfer belt/electrophotographic photosensitive member integral cartridge, and vibration in the horizontal direction is continuously applied for 3 minutes at a vibration acceleration of 5 m/sec$^2$, with a vibration waveform of a sinusoidal wave and at a frequency of 10 Hz by means of a vibration generator prescribed in JIS Z0232. Immediately thereafter, the surface potential of the part at which the electrophotographic photosensitive member comes into rubbing friction with the intermediate transfer belt is measured with a surface potentiometer MODEL344, manufactured by TREK Co. The measured value obtained is expressed as the electrophotographic photosensitive member surface potential Vt.

The instruments used in the measurement, the intermediate transfer belt and the electrophotographic photosensitive member are left standing for at least 8 hours in an environment of 23±1° C. and 60±5% RH, and the measurement is made in the like environment.

In the case of an intermediate transfer belt/electrophotographic photosensitive member integral cartridge having a mechanism to separate the intermediate transfer belt and the electrophotographic photosensitive member, the surface potential of the electrophotographic photosensitive member after application of vibration under the above vibration conditions is measured in the state the intermediate transfer belt and the electrophotographic photosensitive member are separated, and the measured value obtained is expressed as Vt.

(II) Measurement of electrophotographic photosensitive member surface potential when the space member and the electrophotographic photosensitive member are rubbed with each other:

The intermediate transfer belt, the electrophotographic photosensitive member and the space member are incorporated in the intermediate transfer belt/electrophotographic photosensitive member integral cartridge, and vibration in the horizontal direction is continuously applied for 3 minutes at a vibration acceleration of 5 m/sec$^2$, with a vibration waveform of a sinusoidal wave and at a frequency of 10 Hz by means of a vibration generator prescribed in JIS Z0232. Immediately thereafter, the surface potential of the part at which the electrophotographic photosensitive member comes into rubbing friction with the intermediate transfer belt is measured with a surface potentiometer MODEL344, manufactured by TREK Co. The measured value obtained is expressed as the electrophotographic photosensitive member surface potential Vt.

The instruments used in the measurement, the intermediate transfer belt, the space member and the electrophotographic photosensitive member are left standing for at least 8 hours in an environment of 23±1° C. and 60±5% RH, and the measurement is made in the like environment.

Measurement of surface roughness:

This measurement is made according to JIS B0601.

Measurement of volume resistivity:

As to measuring instruments, an ultra-high resistance meter R8340A (manufactured by Advantest Co.) is used as a resistance meter, and Sample Box TR42 is used for ultra-high resistance measurement (manufactured by Advantest Co.) as a sample box. The main electrode is 25 mm in diameter, and the guard-ring electrode is 41 mm in inner diameter and 49 mm in outer diameter.

A sample is prepared in the following way.

First, the electrophotographic belt is cut in a circular form of 56 mm in diameter by means of a punching machine or a sharp knife. The circular cut piece obtained is fitted, on its one side, with an electrode over the whole surface by forming a Pt—Pd deposited film and, on the other side, fitted with a main electrode of 25 mm in diameter and a guard electrode of 38 mm in inner diameter and 50 mm in outer diameter by forming Pt—Pd deposited films.

The Pt—Pd deposited films are formed by carrying out vacuum deposition for 2 minutes using Mild Sputter E1030 (manufactured by Hitachi Ltd.). The one on which the vacuum deposition has been completed is used as a measuring sample.

Measurement is conducted in a measurement atmosphere of 23±1° C./60±5% RH. The measuring sample is previously left standing in the like atmosphere for 12 hours or longer. Measurement is made under a mode of discharge for 10 seconds, charge for 30 seconds and measurement for 30 seconds and at an applied voltage of 100 V.

Measurement of thickness:

Thickness unevenness of the intermediate transfer belt of the present invention is measured with a dial gauge measurable by 1 μm as a minimum value, over the whole periphery of the belt at points 50 mm apart from both ends and, in respect of the middle, at four points at equal intervals in the peripheral direction. Measurements at 12 points in total for each intermediate transfer belt are averaged.

The present invention is described below in greater detail by giving Examples. In the following, "part(s)" means "part(s) by weight".

EXAMPLE 1

Production of intermediate transfer belt:

Mixing proportion was as follows:

| | |
|---|---|
| Polyvinylidene fluoride resin (PVDF) | 100 parts |
| Polyether ester amide resin | 12 parts |
| Zinc oxide | 20 parts |

Materials used in the above mixing proportion were melt-kneaded at 210° C. by means of a twin-screw extruder to be mixed with each other, and the mixture obtained was extruded in the shape of a strand of about 2 mm in diameter, followed by cutting into pellets. This is used as an extrusion material.

Next, in the extrusion apparatus shown in FIG. 3, the extruder die 103 was set as a single-layer circular die, and one having a die slit outer diameter of 100 mm was used. The die slit of the circular was 0.8 mm in width.

The above extrusion material, having been sufficiently dried by heating, was put into the hopper 102 of this extrusion apparatus, and heated and melted. The molten product was extruded in a tubular form at 210° C. from the circular die 103. The outside-cooling ring 105 was provided around the circular die 103, and air was blown from the circumference to the film extruded in a tubular form to effect cooling.

Air is blown to the interior of the extruded tubular film through the gas inlet passage 104 to cause the film to inflate while scaling up to have a diameter of 140 mm. Thereafter, the film was continuously drawn off at a constant speed by means of the draw-off unit. Here, the air was stopped being fed at the time the diameter became the desired value.

Subsequently to the draw-off through the pinch rollers, the tubular film was cut with the cutter 108. The film was cut in a length of 310 mm after its thickness became stable to form a tubular film.

For this tubular film, its size and surface smoothness were regulated and folds were removed, using the pair of cylindrical forms made of metals, which are different from each other in their coefficients of thermal expansion.

More specifically, the tubular film was placed over the inner form, having a higher coefficient of thermal expansion, and this inner form with the film was inserted into the outer form having been worked to have a smooth inner surface, followed by heating at 170° C. for 20 minutes. After cooling, the tubular film was removed from these cylindrical forms, and its ends were cut away, thus producing an intermediate transfer belt of 140 mm in outer diameter.

Production of electrophotographic photosensitive member:

An aluminum cylinder (volume resistivity: $10^{-2}$ Ω·cm) of 47 mm in outer diameter was used as a support, and was dip-coated with a 5% methanol solution of a solvent-soluble nylon, followed by drying to provide a subbing layer of 1 μm thick.

Next, 10 parts by weight of a bisazo pigment, 5 parts by weight of polyvinyl butyral and 50 parts by weight of cylcohexanone were dispersed for 20 hours by means of a sand mill making use of glass beads of 1 mm in diameter. To the dispersion thus formed, 100 parts by weight of methyl ethyl ketone was added to prepare a coating fluid, which was then applied on the subbing layer, followed by drying to form a charge generation layer of about 0.1 μm in layer thickness.

Next, 10 parts by weight of bisphenol-Z polycarbonate and 10 parts by weight of a hydrazone compound were dissolved in 65 parts by weight of monochlorobenzene to prepare a coating solution, which was then applied on the charge generation layer, followed by drying to form a charge transport layer of 20 μm in layer thickness, thus obtaining an electrophotographic photosensitive member.

Measurement of physical properties:

This intermediate transfer belt was left for 24 hours in an environment of 23±1° C. and 60±5% RH, and its physical properties were measured.

As a result, this intermediate transfer belt was found to have a surface roughness Ra of 0.03 μm, a thickness of 102±5 μm and a volume resistivity of $3.2\times10^{11}$ Ω·cm.

A process cartridge used in Examples and Comparative Examples is described below.

Figure 5:
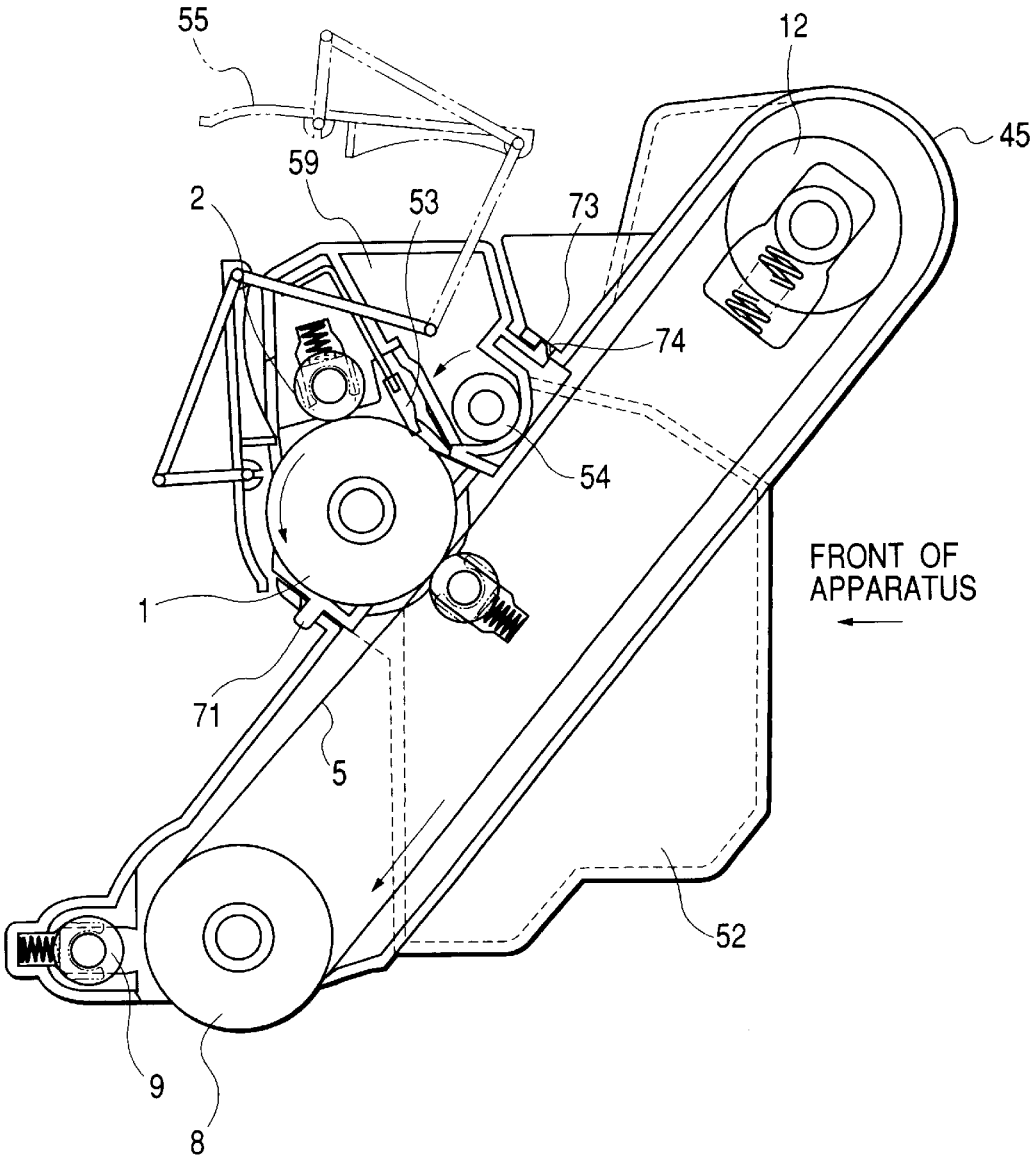
FIG. 5 is a schematic view showing the construction of a process cartridge comprising an electrophotographic photosensitive member unit and an intermediate transfer belt unit which are joined to each other, used in Examples and Comparative Examples.

FIG. 5 schematically illustrates the construction of a process cartridge comprising an electrophotographic photosensitive member unit having an electrophotographic photosensitive member and an intermediate transfer belt unit having an intermediate transfer belt which are joined together.

Figure 6:
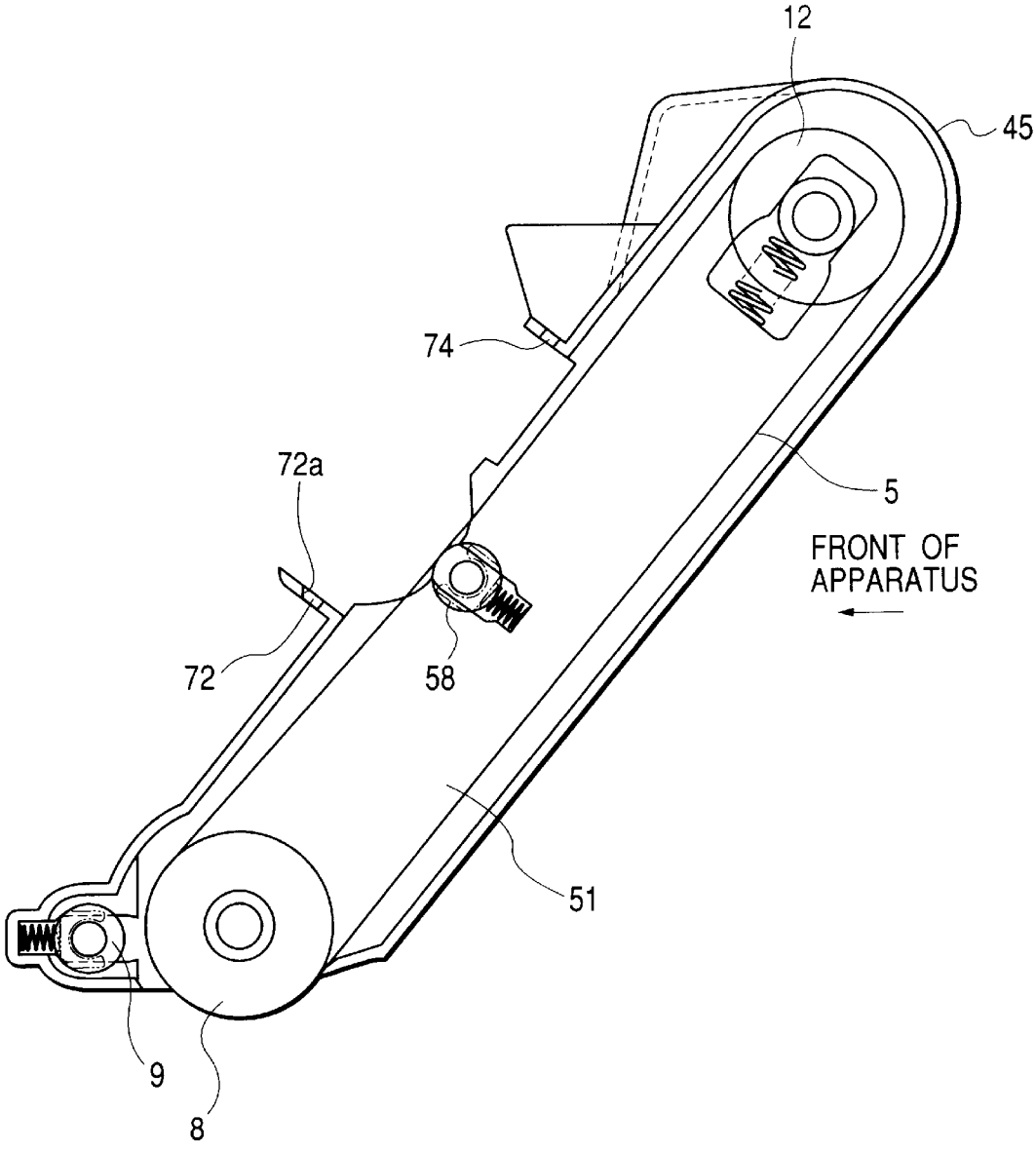
FIG. 6 is a schematic view showing the construction of the intermediate transfer belt unit.
Figure 7:
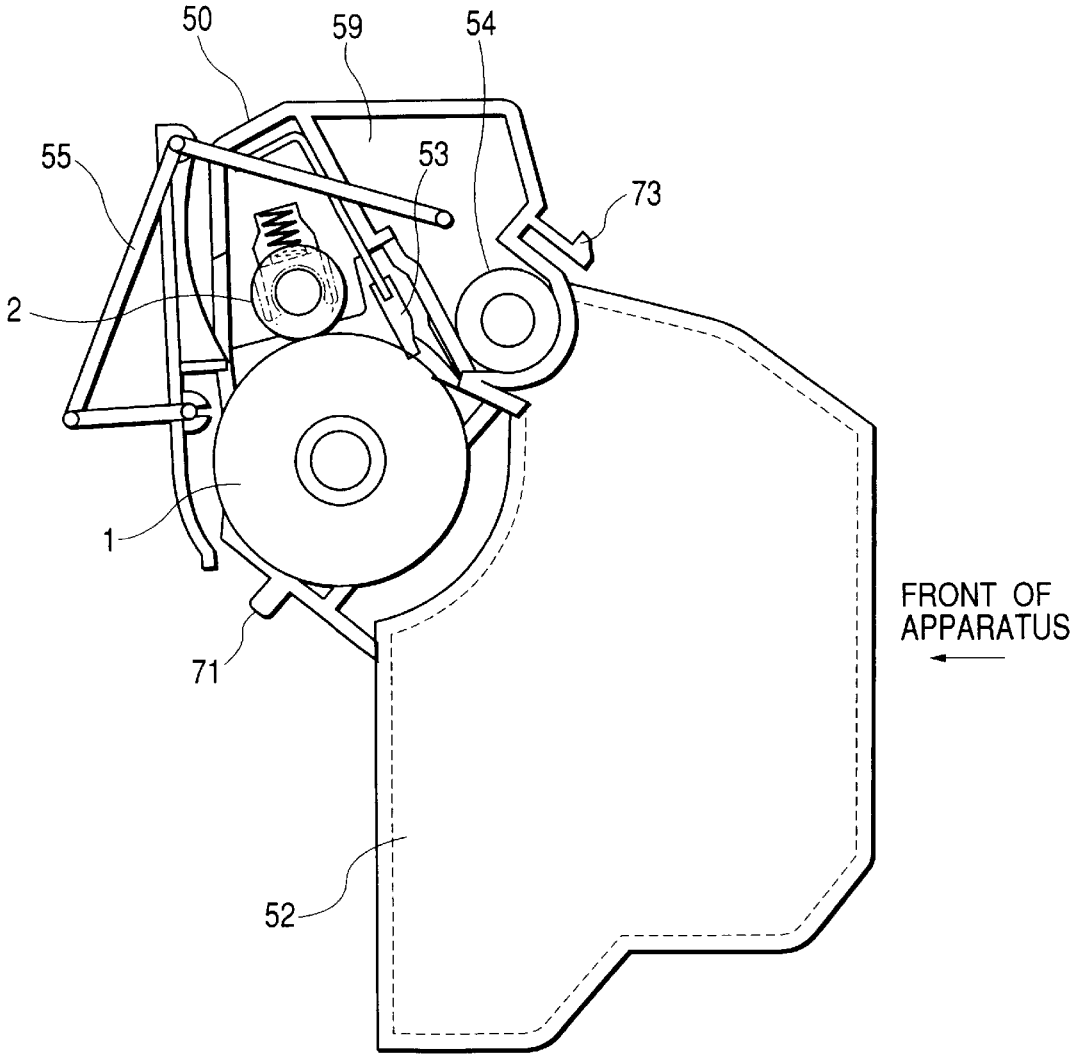
FIG. 7 is a schematic view showing the construction of the electrophotographic photosensitive member unit.

FIGS. 6 and 7 schematically illustrate the construction of the intermediate transfer belt unit and that of the electrophotographic photosensitive member unit, respectively.

Frame construction of the process cartridge is roughly divided into two parts.

It is divided into an electrophotographic photosensitive member frame 59 constructed integrally with a waste-toner container 52, shown in FIGS. 5 and 7, and an intermediate transfer belt frame 45 shown in FIGS. 5 and 6. The former comprises an electrophotographic photosensitive member unit constituted of an electrophotographic photosensitive member 1, a charging roller 2, a cleaning blade 53, a screw 54 and a drum shutter 55 as chief component parts. The latter comprises an intermediate transfer belt unit 51 having i) an intermediate transfer belt 5 which is placed over and around a drive roller 8 and a follower roller (tension roller) 12, ii) a primary-transfer roller 58 provided on the inside of the intermediate transfer belt at its part facing the electrophotographic photosensitive member 1 and iii) a charge-providing means (intermediate-transfer-belt cleaning roller) 9 provided at the drive roller 8.

These two units are joined in such a way that projections 71 provided at both ends of the electrophotographic photosensitive member frame 59 are respectively inserted into registration holes 72 provided in the intermediate transfer belt frame 45 and that a hook 73 at a snap-fitting hooking part provided at the middle in the width direction of the electrophotographic photosensitive member frame 59 is fitted into a lock hole 74 of the intermediate transfer belt frame 45.

Here, the registration holes 72 and the lock hole 74 provided in the intermediate transfer belt frame 45 are made a little larger by a certain extent than the projections 71 and hook 73 provided on the electrophotographic photosensitive member frame 59, and the electrophotographic photosensitive member unit 50 and the intermediate transfer belt unit 51 are so constructed that relative positional movement to a certain extent is allowable between them.

The registration holes 72 are each provided with a taper 72*a* so that the unit can be attached or detached with ease.

In the process cartridge shown in FIG. 5, the hook 73 of the electrophotographic photosensitive member unit 50 may be pushed to be unhooked from the lock hole 74 of the intermediate transfer belt unit 51, and the electrophotographic photosensitive member unit 50 may be turned around. Thus, the process cartridge can be divided into the electrophotographic photosensitive member unit and the intermediate transfer belt unit as shown in FIGS. 6 and 7.

When joined, contrary to the foregoing, the projections 71 of the electrophotographic photosensitive member unit 50 can be inserted into the registration holes 72 of the intermediate transfer belt unit 51, and the electrophotographic photosensitive member unit 50 can be turned around in the direction opposite to that at the time of detachment to push the hook 73 into the lock hole 74, thereby joining the two units.

Figure 8:
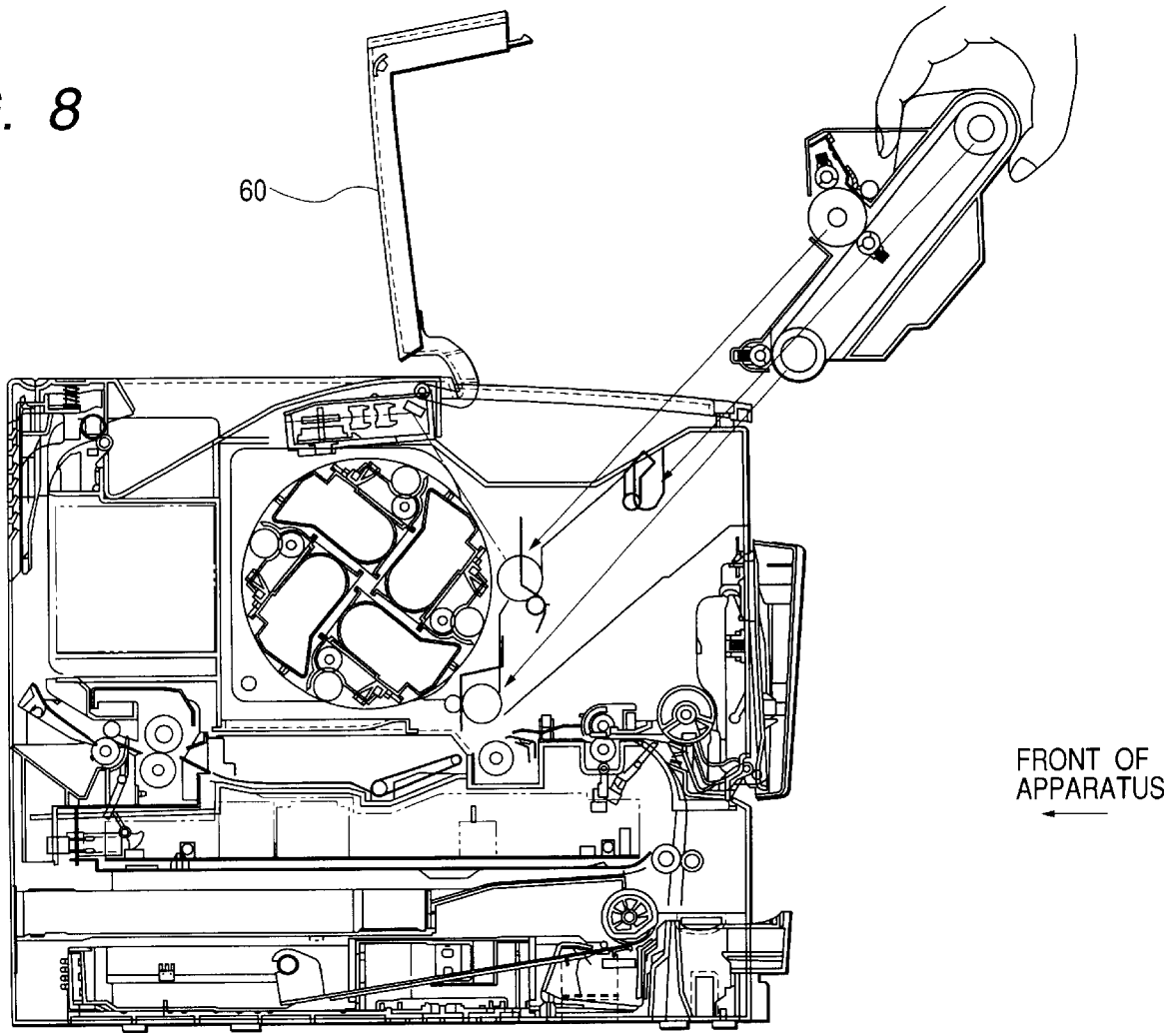
FIG. 8 is a view showing how the process cartridge of the present invention is attached to or detached from the electrophotographic apparatus.

FIG. 8 illustrates how the process cartridge of the present invention is attached to or detached from the electrophotographic apparatus.

Only a top cover 60 of the electrophotographic apparatus main body can be opened to attach or detach the process cartridge simply as in conventional black-and-white laser beam printers. Thus, maintenance operations such as the handling of paper jamming and replacement of the process cartridge can be performed with ease.

Image evaluation:

The above intermediate transfer belt and electrophotographic photosensitive member were incorporated in the intermediate transfer belt/electrophotographic photosensitive member integral cartridge constructed as shown in FIGS. 2 and 5. Here, the spring pressure of the tension roller was 20 N in total for the right and the left and the extent of slide was 2.5 mm. The tension roller and the drive roller each had a diameter of 28 mm.

Subsequently, for an acceleration test, this process cartridge was left standing in a high-temperature environment of 40° C. for 14 days. Thereafter, this cartridge was allowed to stand still in an environment of 23° C. and 55% RH for 12 hours, and then set in the electrophotographic apparatus constructed as shown in FIG. 1, to test full-color image reproduction on 80 g/m$^2$ paper in the same environment.

The developing unit used here employed a digital laser system with a resolution of 600 dpi.

Images obtained were visually evaluated, where good full-color images free of any problems such as color misregistration, uneven density and blank areas caused by poor transfer were obtained.

Subsequently, a continuous 5,000-sheet printing test (running test) was made at a printing speed of 4 sheets per minute to evaluate images in the same way, where the same good images as those at the initial stage were obtained. Thus, it was ascertained that the intermediate transfer belt/electrophotographic photosensitive member integral cartridge making use of the above intermediate transfer belt had good performance.

During the running print test, the belt did neither meander nor come on one side, and any folding and bending caused by the belt materials did not occur.

The results of measurement and evaluation are shown in Table 1.

EXAMPLE 2

An intermediate transfer belt was produced in the same manner as in Example 1 except that the mixing materials were changed as shown below.

Mixing proportion was as follows:

| | |
|---|---|
| Polyarylate resin | 100 parts |
| Polyether-containing antistatic resin (polyolefin-polyethr resin; conductive resin) | 8 parts |
| Sulfonate type surface-active agent (calcium hexylbenzenesulfonate) | 4 parts |

Using this intermediate transfer belt, physical properties were measured and image printing was tested in the same manner as in Example 1.

As a result, this intermediate transfer belt was found to have a surface roughness Ra of 0.04 μm, a thickness of 210±10 μm and a volume resistivity of $9.5\times10^{9}$ Ω·cm.

The results of the printing test made using the intermediate transfer belt were as good as those in Example 1.

The results of measurement and evaluation are shown in Table 1.

EXAMPLES 3 TO 5 AND COMPARATIVE EXAMPLES 1 AND 2

Intermediate transfer belts were produced in the same manner as in Example 1 except that the belt peripheral length and thickness and the roller diameter were changed as shown in Table 1. Using these belts, physical properties were measured and image printing was tested in the same way.

The results of measurement and evaluation are shown in Table 1.

In Table 1, numerals 1 to 5 represent evaluation results for the belt travel performance, the belt durability, the image quality and the transfer performance, where the larger the numeral, the better the result. Among the numerals, numerals 1 to 3 indicate that the effect intended in the present invention was judged not to be obtained.

The process cartridges used in Examples 1 to 5 and Comparative Examples 1 and 2 are process cartridges, the intermediate transfer belts of which are placed over and around two rollers, and the two rollers have equal diameter in each Example and Comparative Example.

TABLE 1

| | Example 1 | Example 2 | Example 3 | Example 4 | Example 5 | Comparative Example 1 | Comparative Example 2 |
|---|---|---|---|---|---|---|---|
| Belt peripheral length L: (mm) | 140 | 140 | 380 | 185 | 380 | 140 | 380 |
| Belt average thickness t: (mm) | 0.102 | 0.210 | 0.450 | 0.180 | 0.067 | 0.750 | 0.007 |
| Roller diameter R: (mm) | 28 | 28 | 28 | 37 | 45 | 28 | 47.5 |
| Belt volume resistivity: (Ω · cm) | $3.2 \times 10^{11}$ | $9.5 \times 10^{9}$ | $2.7 \times 10^{12}$ | $7.3 \times 10^{6}$ | $4.1 \times 10^{9}$ | $8.1 \times 10^{14}$ | $3.9 \times 10^{10}$ |
| Belt travel performance: | 5 | 5 | 4 | 5 | 4 | 2~3 *1) | 2 |
| Belt durability: | 5 | 5 | 5 | 5 | 4 *2) | 5 | 2 *3) |
| Image quality*: | 5 | 5 | 4 | 4 | 4 | 2 *4) | 1~2 |
| Transfer performance: | 5 | 5 | 4 | 4 | 5 | 1~2 *5) | 1 *6) |

*such as color (image) misregistration, fog and coarse images
*1) Poor running performance because of inferior flexibility.
*2) Slightly wrinkled at the finish of running.
*3) Belt wrinkled during running.
*4) Color (image) misregistration of 1 mm at maximum.
*5) High-tension transfer electric field is necessary.
*6) Belt has poor resistance to pressure.

The process cartridge of the present invention is the intermediate transfer belt/electrophotographic photosensitive member integral cartridge which employs the cleaning-at-primary-transfer (bias cleaning) method as a method of cleaning the intermediate transfer belt and which is dividable into the electrophotographic photosensitive member unit and the intermediate transfer belt unit and has a joining means which joins the two units. Hence, it can eliminate the user's difficulty in replacing the process cartridge, and can prevent usability from being damaged by, e.g., the escape of waste toner from the waste-toner connecting part between the two process cartridges. In addition, the number of component parts can be cut down, and space and frame rigidity are not required so much as in conventional process cartridges, and hence the cost can be kept from increasing.

Employing the intermediate transfer belt and the rollers over and around which the intermediate transfer belt is placed, in which the peripheral length and average thickness of the intermediate transfer belt and the diameter of at least one of the rollers over and around which the intermediate transfer belt is placed satisfy the above-discussed specific relationship, enhancing travel performance, durability, image quality and transfer performance of the intermediate transfer belt.

The electrophotographic apparatus having such a process cartridge, the image-forming method making use of the electrophotographic apparatus and the intermediate transfer belt mounted on the process cartridge can also enjoy the same effect as the above.

What is claimed is:

1. A process cartridge which is detachably mountable on a main body of an electrophotographic apparatus, said process cartridge comprising the following integrally supported therein:

an electrophotographic photosensitive member configured to hold thereon a toner image;

an intermediate transfer belt having a contact zone coming into contact with said electrophotographic photosensitive member;

a primary-transfer means for primarily transferring the toner image from said electrophotographic photosensitive member to said intermediate transfer belt at the contact zone;

a charge-providing means for providing the toner on said intermediate transfer belt with electric charges having a polarity reverse to a polarity the toner has at the time of the primary transfer and returning the toner on said intermediate transfer belt to said electrophotographic photosensitive member at the contact zone to clean said intermediate transfer belt; and an electrophotographic-photosensitive-member cleaning means for cleaning said electrophotographic photosensitive member;

said process cartridge being dividable into an electrophotographic photosensitive member unit having said electrophotographic photosensitive member and an intermediate transfer belt unit having said intermediate transfer belt, and further comprising joining means for joining said electrophotographic photosensitive member unit and said intermediate transfer belt unit together; and the peripheral length L (mm) of said intermediate transfer belt, the average thickness t (mm) of said intermediate transfer belt and the diameter R (mm) of at least one of rollers over and around which said intermediate transfer belt is placed satisfying all the following expressions (1) to (4):

(1) $2\times10^2\pi \leqq L/t \leqq 4\times10^4\pi$;

(2) $2\times10^{-4} \leqq t/R \leqq 1.5\times10^{-2}$;

(3) $0.005<t<0.6$; and (4) $5<R<90$.

2. The process cartridge according to claim 1, wherein said intermediate transfer belt has a volume resistivity of from $1\times10^2$ Ω·cm to $8\times10^{13}$ Ω·cm.

3. The process cartridge according to claim 1, wherein said electrophotographic photosensitive member unit and said intermediate transfer belt unit each have a registration unit with which they are positionally adjusted to the main body of the electrophotographic apparatus when attached to the main body of the electrophotographic apparatus.

4. The process cartridge according to claim 1, wherein at least one of said electrophotographic photosensitive member unit and said intermediate transfer belt unit has a waste-toner container configured and positioned to collect and accumulate waste toner having come from at least one of the cleaning of said electrophotographic photosensitive member by said electrophotographic-photosensitive-member cleaning means and the cleaning of said intermediate transfer belt by intermediate-transfer-belt cleaning means for cleaning said intermediate transfer belt.

5. The process cartridge according to claim 1, wherein said electrophotographic photosensitive member is a drum-shaped electrophotographic photosensitive member which is a rigid body having a diameter of 60 mm or less.

6. The process cartridge according to claim 1, wherein said intermediate transfer belt is placed over and around two rollers.

7. An electrophotographic apparatus comprising:

an electrophotographic photosensitive member configured to hold thereon a toner image;

charging means for electrostatically charging said electrophotographic photosensitive member;

exposure means for forming an electrostatic latent image on said electrophotographic photosensitive member thus charged by said charging means;

developing means for developing with toner the electrostatic latent image formed on said electrophotographic photosensitive member by said exposure means, to form a toner image on said electrophotographic photosensitive member;

an intermediate transfer belt having a contact zone coming into contact with said electrophotographic photosensitive member, through which the toner image is primarily transferred from said electrophotographic photosensitive member and thereafter the toner image having primarily been transferred is secondarily transferred to a transfer medium;

primary-transfer means for primarily transferring the toner image from said electrophotographic photosensitive member to said intermediate transfer belt at the contact zone;

charge-providing means for providing the toner on said intermediate transfer belt with electric charges having a polarity reverse to a polarity the toner has at the time of the primary transfer and returning the toner on said intermediate transfer belt to said electrophotographic photosensitive member at the contact zone to clean said intermediate transfer belt; and electrophotographic-photosensitive-member cleaning means for cleaning said electrophotographic photosensitive member;

said electrophotographic apparatus having a process cartridge in which said electrophotographic photosensitive member, said intermediate transfer belt, said primary-transfer means, said charge-providing means and said electrophotographic-photosensitive-member cleaning means at least are integrally supported and which is detachably mountable on a main body of said electrophotographic apparatus;

said process cartridge being dividable into an electrophotographic photosensitive member unit having said electrophotographic photosensitive member and an intermediate transfer belt unit having said intermediate transfer belt, and comprising joining means for joining said electrophotographic photosensitive member unit and said intermediate transfer belt unit together; and the peripheral length L (mm) of said intermediate transfer belt, the average thickness t (mm) of said intermediate transfer belt and the diameter R (mm) of at least one of rollers over and around which said intermediate transfer belt is placed satisfying all the following expressions (1) to (4):

(1) $2\times10^2\pi \leqq L/t \leqq 4\times10^4\pi$;

(2) $2\times10^{-4} \leqq t/R \leqq 1.5\times10^{-2}$;

(3) $0.005<t<0.6$; and (4) $5<R<90$.

8. The electrophotographic apparatus according to claim 7, wherein said intermediate transfer belt has a volume resistivity of from $1\times10^2$ Ω·cm to $8\times10^{13}$ Ω·cm.

9. The electrophotographic apparatus according to claim 7, wherein said electrophotographic photosensitive member unit and intermediate transfer belt unit of said process cartridge each have a registration unit with which they are positionally adjusted to the main body of said electrophotographic apparatus when attached to the main body of said electrophotographic apparatus.

10. The electrophotographic apparatus according to claim 7, wherein at least one of said electrophotographic photosensitive member unit and intermediate transfer belt unit of said process cartridge has a waste-toner container configured and positioned to collect and accumulate waste toner having come from at least one of the cleaning of said electrophotographic photosensitive member by said electrophotographic-photosensitive-member cleaning means and the cleaning of said intermediate transfer belt by intermediate-transfer-belt cleaning means for cleaning said intermediate transfer belt.

11. The electrophotographic apparatus according to claim 7, wherein said electrophotographic photosensitive member is a drum-shaped electrophotographic photosensitive member which is a rigid body having a diameter of 60 mm or less.

12. The electrophotographic apparatus according to claim 7, wherein said intermediate transfer belt is placed over and around two rollers.

13. An image-forming method comprising:

a charging step of electrostatically charging an electrophotographic photosensitive member;

an exposure step of forming an electrostatic latent image on the electrophotographic photosensitive member thus charged in said charging step;

a developing step of developing with toner the electrostatic latent image formed on the electrophotographic photosensitive member in said exposure step, to form a toner image on the electrophotographic photosensitive member;

a primary-transfer step of primarily transferring the toner image formed in said developing step from the electrophotographic photosensitive member to an intermediate transfer belt by a primary-transfer means, the intermediate transfer belt having a contact zone coming into contact with the electrophotographic photosensitive member;

a secondary-transfer step of secondarily transferring to a transfer medium the toner image having primarily been transferred in said primary-transfer step;

a charge-providing step of providing the toner on the intermediate transfer belt with electric charges by a charge-providing means, the electric charges having a polarity reverse to a polarity the toner has at the time of the primary transfer;

an intermediate-transfer-belt cleaning step of returning the toner on the intermediate transfer belt to the electrophotographic photosensitive member at the contact zone to clean the intermediate transfer belt; and an electrophotographic-photosensitive-member cleaning step of cleaning the electrophotographic photosensitive member with an electrophotographic-photosensitive-member cleaning means;

said image-forming method making use of an electrophotographic apparatus having a process cartridge in which the electrophotographic photosensitive member, the intermediate transfer belt, the primary-transfer means, the charge-providing means and the electrophotographic-photosensitive-member cleaning means at least are integrally supported and detachably mountable on a main body of the electrophotographic apparatus;

the process cartridge being dividable into an electrophotographic photosensitive member unit having the electrophotographic photosensitive member and an intermediate transfer belt unit having the intermediate transfer belt, and having joining means for joining the electrophotographic photosensitive member unit and the intermediate transfer belt unit together; and the peripheral length L (mm) of the intermediate transfer belt, the average thickness t (mm) of the intermediate transfer belt and the diameter R (mm) of at least one of rollers over and around which the intermediate transfer belt is placed satisfying all the following expressions (1) to (4):

(1) $2\times10^2\pi \leqq L/t \leqq 4\times10^4\pi$;

(2) $2\times10^{-4} \leqq t/R \leqq 1.5\times10^{-2}$;

(3) $0.005 < t < 0.6$; and (4) $5 < R < 90$.

14. The image-forming method according to claim 13, wherein the intermediate transfer belt has a volume resistivity of from $1\times10^2$ Ω·cm to $8\times10^{13}$ Ω·cm.

15. The image-forming method according to claim 13, wherein the electrophotographic photosensitive member unit and intermediate transfer belt unit of the process cartridge each have a registration unit with which they are positionally adjusted to the main body of the electrophotographic apparatus when attached to the main body of the electrophotographic apparatus.

16. The image-forming method according to claim 13, wherein at least one of the electrophotographic photosensitive member unit and intermediate transfer belt unit of the process cartridge has a waste-toner container configured and positioned to collect and accumulate waste toner having come from at least one of the cleaning of the electrophotographic photosensitive member by the electrophotographic-photosensitive-member cleaning means and the cleaning of the intermediate transfer belt by intermediate-transfer-belt cleaning means for cleaning the intermediate transfer belt.

17. The image-forming method according to claim 13, wherein the electrophotographic photosensitive member is a drum-shaped electrophotographic photosensitive member which is a rigid body having a diameter of 60 mm or less.

18. The image-forming method according to claim 13, wherein the intermediate transfer belt is placed over and around two rollers.

* * * * *

UNITED STATES PATENT AND TRADEMARK OFFICE

CERTIFICATE OF CORRECTION

PATENT NO. : 6,718,148 B2
DATED : April 6, 2004
INVENTOR(S) : Hiroyuki Kobay Ashi et al.

It is certified that error appears in the above-identified patent and that said Letters Patent is hereby corrected as shown below:

Title page,
Item [*] Notice, should read -- [*] Notice: subject to any disclaimer the term of this patent is extended or adjusted under 35 U.S.C. 154(b) by 44 days --.
Item [57], ABSTRACT,
Line 3, "primary" should read -- a primary --.

Column 7,
Line 34, "which.it" should read -- which it --.

Column 8,
Line 41, "the above," should be deleted.

Column 10,
Line 47, "having" should read -- having been --.

Column 14,
Line 53, "the state the" should read -- in the plate in which the --

Column 16,
Line 8, "circular" should read -- circular die --.

Signed and Sealed this

Twenty-sixth Day of July, 2005

JON W. DUDAS
*Director of the United States Patent and Trademark Office*

UNITED STATES PATENT AND TRADEMARK OFFICE

CERTIFICATE OF CORRECTION

PATENT NO. : 6,718,148 B2
DATED : April 6, 2004
INVENTOR(S) : Kobayashi et al.

It is certified that error appears in the above-identified patent and that said Letters Patent is hereby corrected as shown below:

Title page,
Item [75], Inventors, "Hidehiko Matsuda" should be -- Hidekazu Matsuda --.

Signed and Sealed this

Tenth Day of January, 2006

JON W. DUDAS
*Director of the United States Patent and Trademark Office*